United States Patent [19]

Dingler

[11] 4,188,017

[45] Feb. 12, 1980

[54] TENSIONING DEVICE FOR FRAME PIECES

[76] Inventor: Gerhard Dingler, Ortsstrasse 1, 7274 Haiterback, Fed. Rep. of Germany

[21] Appl. No.: 949,786

[22] Filed: Oct. 10, 1978

[51] Int. Cl.[2] ..... B25B 1/08

[52] U.S. Cl. ..... 254/51; 254/104; 269/234; 269/321 S

[58] Field of Search ..... 254/51, 104; 269/234, 269/321 S

[56] References Cited

U.S. PATENT DOCUMENTS

| | | | |
|---|---|---|---|
| 1,879,099 | 9/1932 | Coffey | 269/234 |
| 2,217,278 | 10/1940 | Kanter | 254/104 |

*Primary Examiner*—Robert C. Watson

[57] ABSTRACT

A pair of L-shaped claws consisting of longitudinal and cross members are substantially congruent, rigidly connected and spaced a short distance from each other. Two aligned elongated openings are provided in the center of each cross member, for receiving a vertically-oriented tensioning wedge. A third claw, substantially congruent with the first two claws is guided with its cross members longitudinally in the space between the first pair, with little play in the transverse directions. This third claw also has an elongated opening in its cross member for receiving the tensioning wedge. The cross sides of the first mentioned elongated openings which contact the tensioning wedge on one side is opposite to the cross side of the last mentioned elongated opening, which contacts the tensioning wedge on its opposite side. A contact surface for the frame piece is provided on the side of the cross members of claw pair, directed toward the outer leg of the frame piece. The longitudinal members of the claws have oblique surfaces directed towards one another which correspond in obliquity to the angle of the outer flank of the frame piece longitudinal bead, so that when the frame piece outer legs rest against the contact surfaces of the cross members on the wedge is driven, the inwardly projecting oblique surfaces rest under pressure against the outer flank of the longitudinal bead.

3 Claims, 5 Drawing Figures

Fig. 4
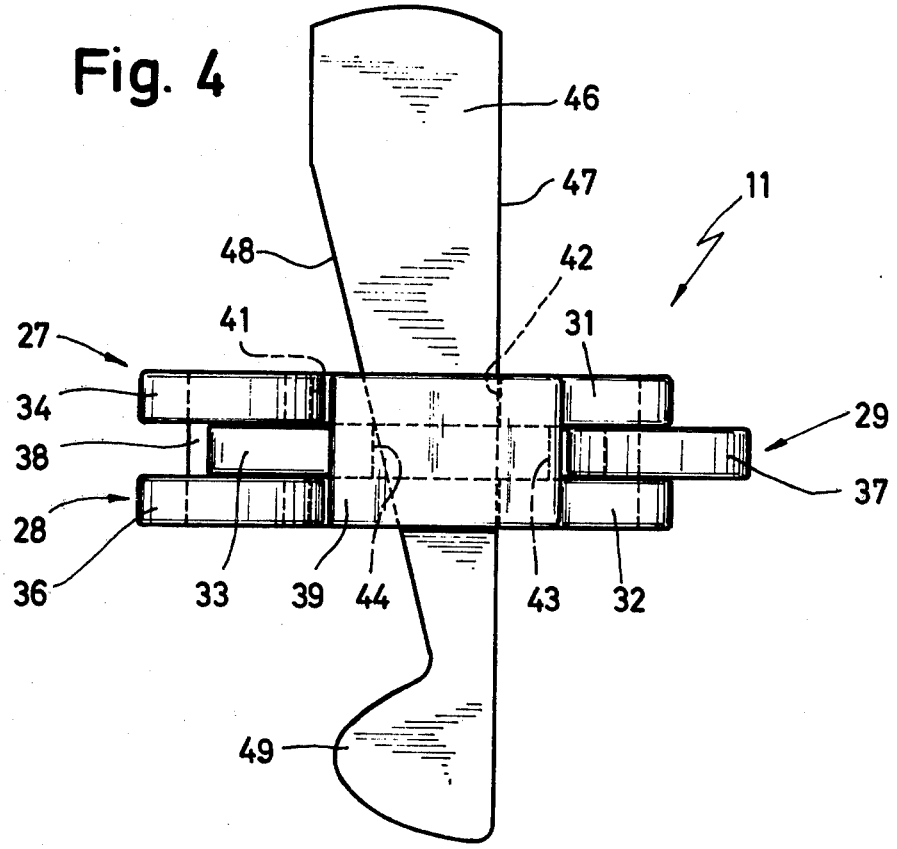
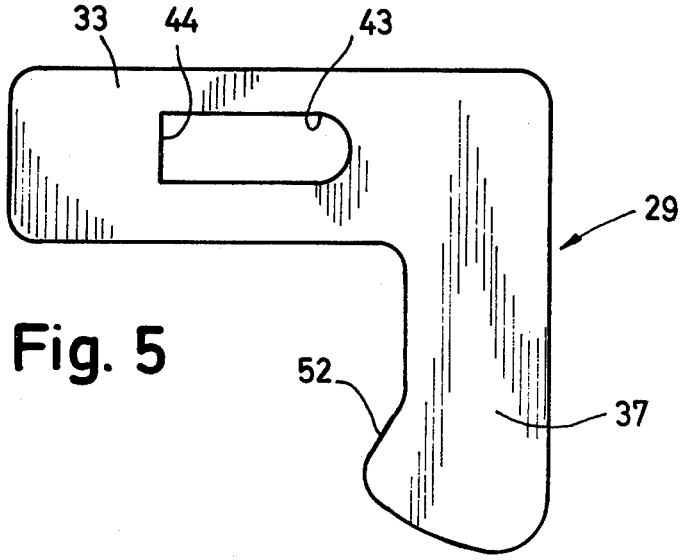
Fig. 5

TENSIONING DEVICE FOR FRAME PIECES

BACKGROUND OF THE INVENTION

The invention relates to a tensioning device for frame pieces, according to German Offenlegungsschrift No. 2,049,245 published Apr. 13, 1972, including a tensioning wedge and a tensioning element.

In this publication, there is described a shuttering which does not, however, always have to be used for boarding purposes only but can also be used in cases where building site walls are erected as a protection against the weather, etc. This publication shows, for example in FIG. 3, a specially formed frame piece profile which comprises a longitudinal bead as well as outer legs which extend parallel to the shuttering board. This frame piece profile has, in its legs which are vertical to the shuttering board, holes through which a tensioning element in the shape of a stressing bolt passes, which bolt has a longitudinal slot. This construction has the following disadvantages:

(a) For tensioning purposes, it is necessary to punch holes into the frame pieces. These holes necessitate an additional operation and weaken the moment of resistance of the frame pieces.

(b) Prior to tensioning, attention has to be paid that the two holes of both juxtaposed frame pieces are aligned so that the tensioning element pulls in the desired direction. In other words, careful attention has to be paid to alignment both on the building site and during production.

(c) A sleeve has to be placed into the holes in order to ensure that the concrete will not run into the frame piece profile. It is true, attempts have been made to prevent the concrete from doing so by filling the hollow portion of the frame piece with a wooden profile. However, this is expensive.

(d) It presents difficulties to connect together shuttering panels which are staggered in height relative to one another because attention has to be paid to the hole pattern. Steps can therefore only be realised with difficulty and frequently outside the shuttering system.

(e) The holes dictate the tensioning location, which sometimes does not coincide with the optimum tensioning location.

(f) Prior to tensioning, attention has to be paid that the shuttering elements are flush because otherwise the concrete surfaces sometimes project forward or backward by several millimeters. The flushness which has initially been established may be lost again during tensioning.

(g) Access to the wedges is difficult when they are driven in. If one is not careful, one hits the frame piece because the wedges bear closely against the frame piece, and this applies particularly to those legs which form a corner with the shuttering board. In practice, the tensioning element is placed in such a way that the wedges extend obliquely from the front top to the rear bottom. However, this means that when the wedges are released there is practically no room for the hammer, for the wedge point is after all even more inaccessible than the wedge head.

It is the object of the invention to indicate a tensioning device which is cheap while suitable for the building site, stands harsh handling and, while suitable for the frame piece system mentioned at the beginning, eliminates all the aforementioned disadvantages.

BRIEF STATEMENT OF THE INVENTION

According to the invention, this problem is solved by the following features:

(a) There are provided two substantially congruent, approximately L-shaped claws which are resistant to bending and are parallel to each other and are rigidly connected together and are arranged at a short distance from each other.

(b) In the centre of the cross member of the L, there are provided two aligned elongate openings which receive the tensioning wedge and which have on one of their cross sides a contact surface for one of the contact sides of the tensioning wedge.

(c) On the cross members, there is provided on the side that is directed towards the outer leg of the frame piece a contact surface for this latter.

(d) A third claw, which is substantially congruent with the first two claws, is guided with its cross member so as to be movable in its longitudinal direction between the cross members of the first two claws but with little play in the two transverse directions and also has an opening which receives the tensioning wedge and has a contact surface for the other contact side of the tensioning wedge on the cross side that is opposite to the first-mentioned contact surfaces.

(e) The longitudinal members of the substantially flat claws have, at their end areas, on the areas which are directed towards one another, oblique surfaces whose obliquity corresponds approximately to the angle of the outer flank of the frame piece longitudinal bead, and when the frame piece outer legs rest against the contact surface and the wedge is driven, the inwardly projecting oblique surfaces rest under pressure against the outer flank of the longitudinal bead.

(f) The wedge is vertical to the tensioning element.

Due to the features of claim 2, there is provided both a good mechanical highly loadable connection at the correct point and simultaneously a defined contact surface which can be easily kept clean.

Due to the features of claim 3, there is obtained a very stable tensioning device which can be readily mass produced.

At the same time, the contact surface zone of the openings receiving the tensioning wedge is protected towards the exterior and a good guidance for the cross member of the third claw is obtained.

Further advantages and features of the invention will now be described with reference to a preferred exemplified embodiment. In the drawings:

BRIEF DESCRIPTION OF THE DRAWINGS

FIG. 4 shows a view of the tensioning device in the direction of the arrow C in FIG. 1, and FIG. 5 shows a top view of the third tensioning claw.

DETAILED DESCRIPTION OF THE INVENTION

Figure 1:
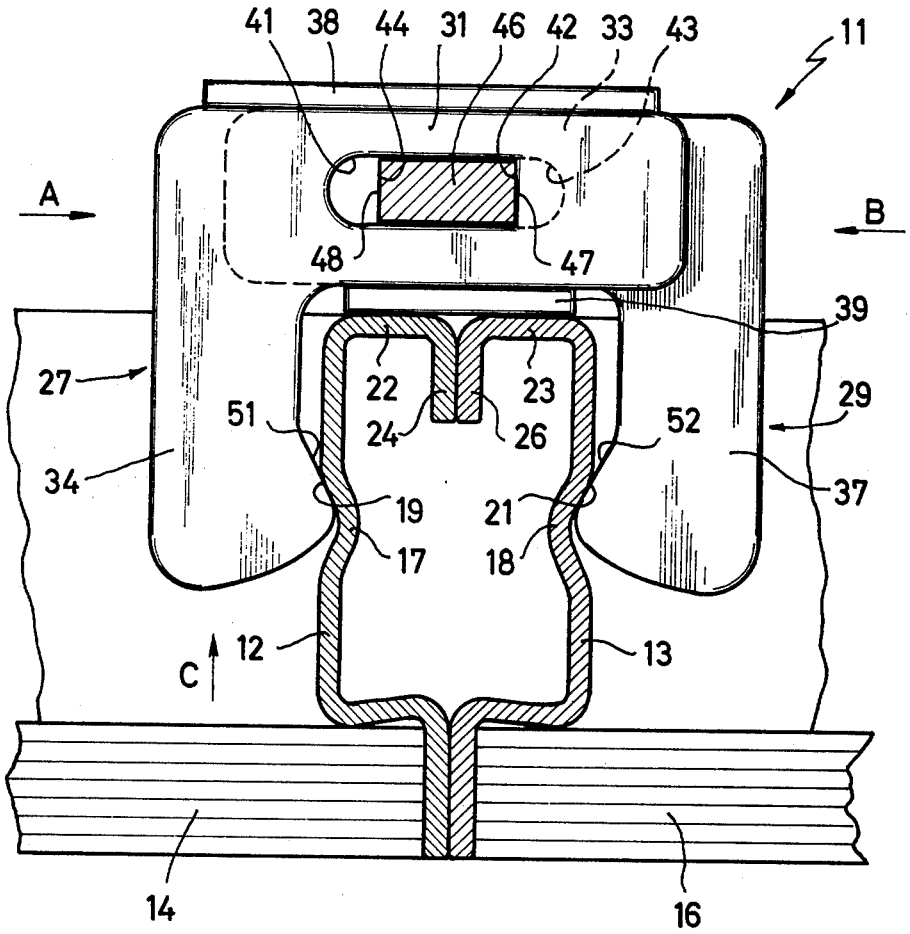
FIG. 1 shows a full-size top view of the tensioning device, applied to two frame pieces with the shuttering board.
Figure 2:
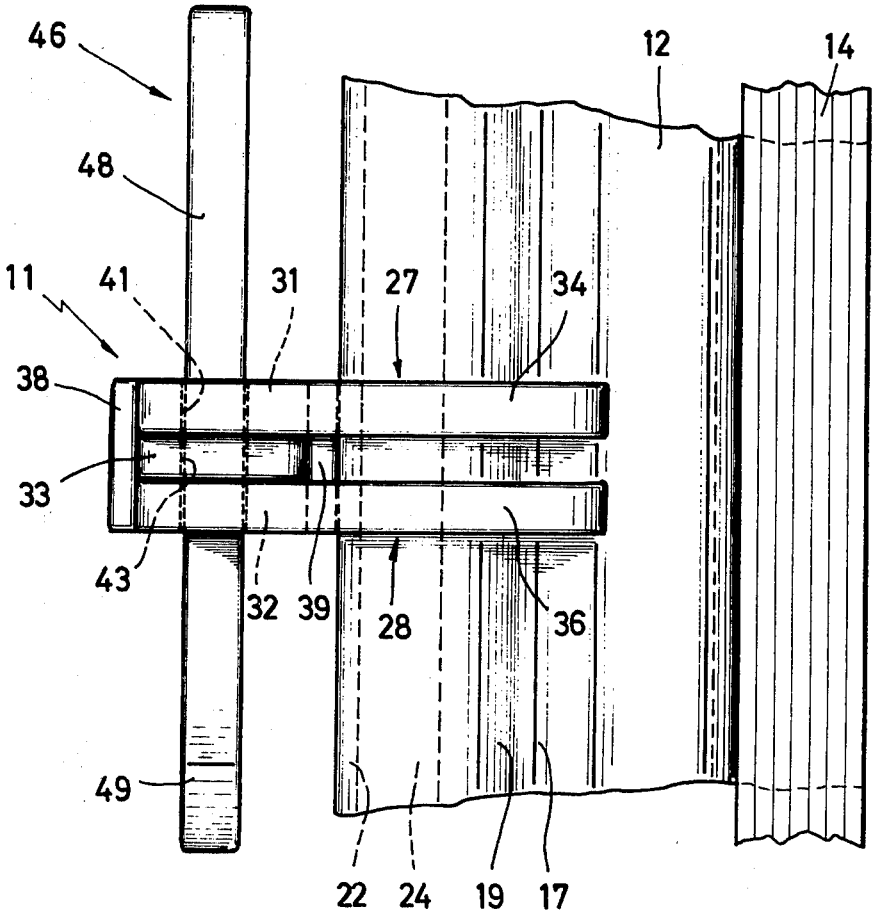
FIG. 2 shows a side view in the direction of the arrow A in FIG. 1.
Figure 3:
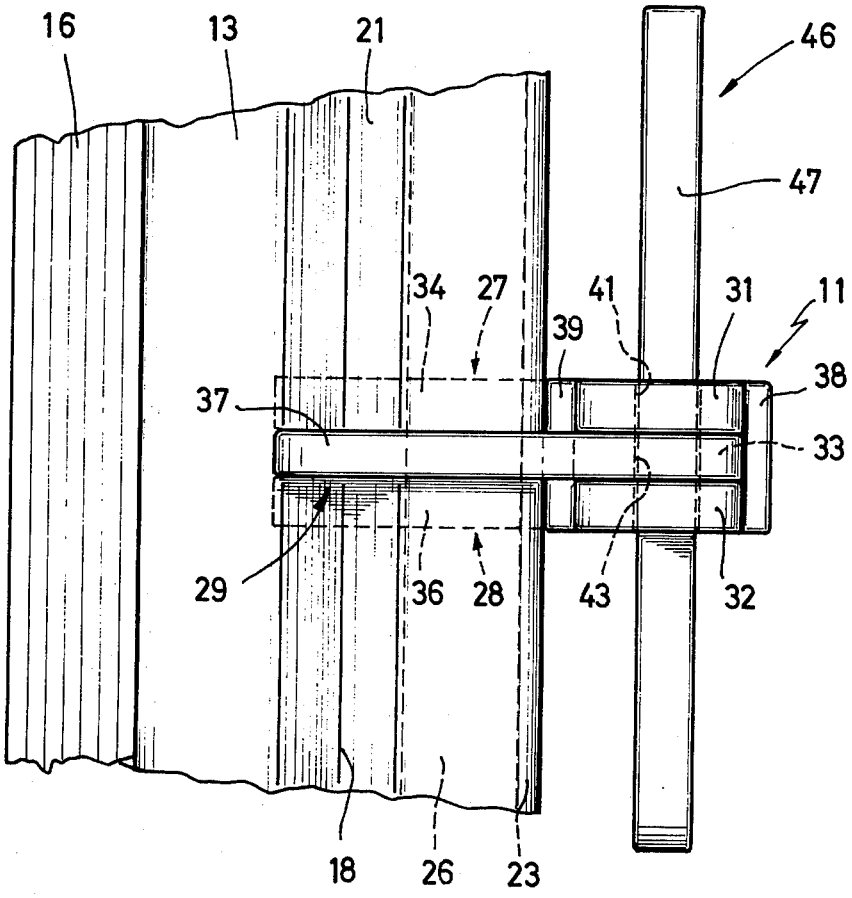
FIG. 3 shows the other side view in the direction of the arrow B in FIG. 1.

A tensioning device 11 is used in conjunction with frame pieces 12, 13 which grip shutter boards 14, 16. A characteristic of the frame pieces 12, 13 are longitudinal beads 17, 18 which have flanks 19, 21. As can be seen, the flanks 19, 21 are acute-angled and serve as slide-on flanks to the tensioning device 11. The frame pieces 12, 13 furthermore have outer legs 22, 23. In the tensioned state of the frame pieces 12, 13, the ribs 24, 26 rest against each other.

The tensioning device 11 substantially comprises a first claw 27, a second claw 28 and a third claw 29. The claws 27, 28, 29 are punched from approximately 8 mm thick steel plate and, for the rest, have the dimensions which can be seen from the full-scale Figures. The claws 27, 28 lie congruently one on top of the other, as can be seen in FIG. 1. The claws 27, 28, 29 each have an approximately L-shaped configuration and comprise cross members 31, 32, 33 and longitudinal members 34, 36, 37. The cross members 31, 32 are rigidly connected together on the outside by a bridge 38 and on the inside by a bridge 39, and this at a distance which is such that the cross member 33 can be moved to and fro between the cross members 31, 32 with little play but is otherwise movable with minimal play only. The bridges 38, 39 may be screwed together with the cross members 31, 32. However, they may just as well be designed as lugs which are integral with the cross member 31 or the cross member 32 or alternately with one of the cross members 31, 32 and are bent through 90° from one cross member towards the other and are welded together therewith.

In the cross members 31, 32, there are provided two openings 41 which are located one above the other and are elongate and have, for the sake of easier production, an arched end on the left-hand side but have a straight contact surface 42 on the right-hand side, as shown in FIG. 1. In the cross member 33, there is provided an opening 43 which is also elongate but has a round end on the right-hand side and a straight contact surface 44 on the left-hand side.

Through the openings 41, 43 passes a wedge 46 which has a head for driving, a contact surface 47 on the right-hand side and a contact surface 48 on the left-hand side, as shown in FIG. 4, is less thick than the openings 41, 43 are high and has at the bottom a nose 49 which ensures that the wedge 46 cannot be lost, in that the nose 49 projects far to the left.

The dimensions are such that the wedge 46 has its maximum tensioning position and that in this position, as shown in FIG. 1, the distance between the contact surfaces 42, 44 is shorter than the length of the openings 41, 43. Therefore, if the wedge 46 is driven, then the longitudinal members 34, 36 move towards the longitudinal member 37. The clear distance between the claws 27, 28, on the one hand, and the claw 29 is thus reduced.

The longitudinal members 34, 36, 37 have oblique surfaces 51, 52 which rest against the flanks 19, 21 and project to the right and left respectively from the inner contour edges of the longitudinal members 34, 36, 37 so that the longitudinal members do not rest against the frame pieces 12, 13 at that point and only the oblique surfaces 51, 52 abut.

When the tensioning device 11 is applied and the wedge 46 is slightly driven, then the contact surfaces 47, 48 initially push, by means of their action of force exerted on the flanks 19, 21, the pieces 22, 23 against the bridge 39 and the frame pieces 12, 13 are brought into alignment. Consequently, the shuttering boards 14, 16 are also aligned. If the wedge 46 is now driven further, then the force additionally produced is used for pressing the frame pieces 12, 13 against each other with much force, which is supported not only by the wedging effect exercised by the wedge 46 but also by the position of the flanks 19, 21 relative to the inclined surfaces 51, 52 since, as the force exerted on the wedge 46 increases, the inclined surfaces 51, 52 slide more and more into the bottom of the longitudinal beads 17, 18.

The lift of the claw 29 relative to the claws 27, 28 is such that the tensioning device 11 can be pushed onto the frame pieces 12, 13 directly from the front, and this is also possible if they are still some millimeters apart. The total lift is approximately 10 mm. The amount of material required is only approximately 1 kg.

What I claim is:

1. A tensioning device for frame pieces having outer surfaces and longitudinal beads, said tensioning device comprising:

two substantially congruent, approximately L-shaped claws formed of cross members and longitudinal members, which are resistant to bending, are parallel to each other, are rigidly connected together and are arranged at a short distance from each other, two aligned elongate openings in the centre of the cross members which receive a tensioning wedge and which have on one of their cross sides a contact surface for one of the contact sides of the tensioning wedge, a contact surface for the frame piece, on the cross members on the side that is directed towards the outer surface of the frame piece, a third claw, which is substantially congruent with the first two claws, guided with its cross member so as to be movable in its longitudinal direction between the cross members of the first two claws but with little play in the two transverse directions and also having an opening which receives the tensioning wedge and a contact surface for the other contact side of the tensioning wedge on the cross side that is opposite to the first-mentioned contact surfaces, the longitudinal members of the substantially flat claws having, at their end areas, on the areas which are directed towards one another, oblique surfaces whose obliquity corresponds approximately to the angle of the outer flank of the frame piece longitudinal bead, so that when the frame piece outer surfaces rest against the contact surface and the wedge is driven, the inwardly projecting oblique surfaces rest under pressure against the outer flank of the longitudinal bead, and a tensioning wedge with spaced contact surfaces on opposite sides, vertical to the tensioning claws.

2. A tensioning device according to claim 1, comprising a bridge connecting the two claws having an outside surface which forms the contact surface.

3. A tensioning device according to claim 2, comprising a bridge connecting the two cross members of the two first claws on their outsides so that the cross member of the third claw is movable within a closed box section.

* * * * *